US007311654B2

(12) United States Patent
Ostkamp

(10) Patent No.: US 7,311,654 B2
(45) Date of Patent: Dec. 25, 2007

(54) SOLID BOWL HELICAL CONVEYOR CENTRIFUGE COMPRISING AN ADJUSTABLE OUTLET FOR SOLIDS

(75) Inventor: Wilhelm Ostkamp, Oelde (DE)

(73) Assignee: Westfalia Separator AG, Oelde (DE)

( * ) Notice: Subject to any disclaimer, the term of this patent is extended or adjusted under 35 U.S.C. 154(b) by 236 days.

(21) Appl. No.: 10/539,444

(22) PCT Filed: Dec. 19, 2003

(86) PCT No.: PCT/EP03/14665

§ 371 (c)(1),
(2), (4) Date: Jun. 20, 2005

(87) PCT Pub. No.: WO2004/058409

PCT Pub. Date: Jul. 15, 2004

(65) Prior Publication Data

US 2006/0089247 A1 Apr. 27, 2006

(30) Foreign Application Priority Data

Dec. 23, 2002 (DE) ..... 102 61 520

(51) Int. Cl.
*B04B 1/20* (2006.01)
*B04B 11/02* (2006.01)

(52) U.S. Cl. ..... 494/53; 494/57

(58) Field of Classification Search ..... 494/52–54, 494/56, 57; 210/380.1, 380.3
See application file for complete search history.

(56) References Cited

U.S. PATENT DOCUMENTS 4,784,634 A * 11/1988 Schiele ..... 494/52
5,169,377 A * 12/1992 Schlip et al. ..... 494/56
5,261,869 A * 11/1993 Caldwell et al. ..... 494/54
5,618,409 A * 4/1997 Kreill ..... 210/360.1
5,653,674 A * 8/1997 Leung ..... 494/53
5,695,442 A * 12/1997 Leung et al. ..... 494/37
2005/0197241 A1* 9/2005 Hensley et al.
2006/0089247 A1* 4/2006 Ostkamp ..... 494/53

FOREIGN PATENT DOCUMENTS

| | | | |
|---|---|---|---|
| DE | 1 823 269 | | 12/1960 |
| JP | 58-205554 | * | 11/1983 |
| JP | 1-127063 | | 5/1989 |
| JP | 2002-15371 | | 5/2002 |
| JP | 2003-135996 | * | 5/2003 |

* cited by examiner

*Primary Examiner*—Charles E. Cooley
(74) *Attorney, Agent, or Firm*—Barnes & Thornburg LLP

(57) ABSTRACT

A solid bowl helical conveyor centrifuge, including a rotatable drum having a horizontally-oriented axis of rotation and a rotatable screw arranged in the rotatable drum. Also included is at least one discharge opening oriented at an angle with respect to the horizontally-oriented axis of rotation. The at least one discharge opening is configured to discharge solids from the rotatable drum. An adjusting device is assigned to the at least one discharge opening and by which adjusting device an outlet cross-section of the at least one discharge opening is changeable. The adjusting device includes a movable adjusting disk arranged in the rotatable drum as an extension of the rotatable screw, and which movable adjusting disk is non-rotatably connected with one or more of the following: a) the rotatable drum, b) the rotatable screw, and c) a screw body. At least one connecting rod is fastened to the movable adjusting disk.

24 Claims, 5 Drawing Sheets

SOLID BOWL HELICAL CONVEYOR CENTRIFUGE COMPRISING AN ADJUSTABLE OUTLET FOR SOLIDS

BACKGROUND

The present disclosure relates to a solid bowl helical conveyor centrifuge including a rotatable drum having a horizontally-oriented axis of rotation. Also included is a rotatable screw arranged in the rotatable drum and at least one discharge opening oriented at an angle with respect to the horizontally-oriented axis of rotation. The at least one discharge opening is configured to discharge solids from the rotatable drum. An adjusting device is assigned to the at least one discharge opening by which adjusting device an outlet cross-section of the at least one discharge opening is changeable. The adjusting device includes a movable adjusting disk arranged in the rotatable drum as an extension of the rotatable screw and which movable adjusting disk is non-rotatably connected with one or more of the following: a) the rotatable drum, b) the rotatable screw, and c) a screw body.

From German Patent Document DE 43 20 265 A1, a solid bowl helical conveyor centrifuge is known which is provided with a weir on the liquid outlet side which has a passage to which an orifice plate is assigned which, during the rotation of the drum, stands still relative to the latter and which, in turn, is axially displaceable by way of a threaded bush. By rotation of the threaded bush, the distance between the weir and the orifice plate can be changed. The resulting change of the discharge cross-section causes a change of the liquid level in the centrifugal drum, so that a continuous adjustment of this liquid level is permitted by the displacement of the orifice plate. However, an adjustment of the discharge of the solids cannot take place.

From European Patent Document EP 0 747 127 B1, it is known to arrange a particularly radially adjustable flow regulating element between worm or screw channels in the conical area of the worm. In this case, a relatively long adjusting path has to be bridged in order to implement a change of the outlet cross-section for the solids.

In contrast, German Patent Document DE 41 19 003 A1, in turn, shows a type of adjustable disk in the transition between the cone and the cylindrical area of the drum and the worm. The adjustment takes place through the worm. The function is that of a baffle plate which also influences the liquid level in the drum.

From European Patent EP 0 565 268 A1, it is known to provide worm channels only in the cylindrical part of a worm body and to place a type of retaining disk at the axial end of the worm body. Among other things, it is a problem that a worm or screw construction has to be selected which basically differs from conventional worm constructions.

From European Patent Document EP 0 798 045 A1, it is known to assign a throughput control device to the discharge opening for the solids. This device is arranged at the exterior side of the drum shell, which is to permit an easy visual inspection of the throughput control device. However, the implementation of the adjustability of the throughput control device at the exterior side of the drum rotating during the operation is relatively problematic because it is not close to the center but has to be implemented on a relatively large diameter where the peripheral speed is relatively high.

With respect to the prior art, Japanese Patent Documents JP 2002 153771A and JP 2003 153772A a well as German Patent Documents DE 41 19 033 A1 and DE 39 21 327 A1 are also known.

A centrifuge is also known from German Patent Document DE 1 823 269. In this document, the non-existent adjustability of the adjusting cone as well as the adjusting device of FIG. 2 by way of a torsional nut from the outside, which requires very high constructional expenditures and is relatively complicated, are problems of some embodiments. An automatic adjusting of the adjusting cone against a spring is also disclosed which, however, in practice does not lead to satisfactory results.

The present disclosure relates to a centrifuge that addresses problems referred to above.

SUMMARY

The present disclosure thus relates to a solid bowl helical conveyor centrifuge including a rotatable drum having a horizontally-oriented axis of rotation. Also included is a rotatable screw arranged in the rotatable drum and at least one discharge opening oriented at an angle with respect to the horizontally-oriented axis of rotation. The at least one discharge opening is configured to discharge solids from the rotatable drum. An adjusting device is assigned to the at least one discharge opening by which adjusting device an outlet cross-section of the at least one discharge opening is changeable. The adjusting device includes a movable adjusting disk arranged in the rotatable drum as an extension of the rotatable screw and which movable adjusting disk is non-rotatably connected with one or more of the following: a) the rotatable drum, b) the rotatable screw, and c) a screw body. Further included is at least one connecting rod fastened to the movable adjusting disk.

Accordingly, at least one or more connecting rods are fastened to the adjusting disk which, while the construction is simple, allows an uncomplicated operation or an adjusting of the adjusting disk from the outside.

The non-rotatable connection of the adjusting disk with the screw or its screw body, the arrangement as an axial extension of the screw, and a selected method of operation permit, for example, "through the screw body", or possibly through the drum, an adjustability of the cross-section of the at least one, or more, discharge opening(s) for the solids. Furthermore, the screw body may have screw channels in a cylindrical section as well as in, for example, a conically tapering section.

The connecting rods, in the sense of displaceable pressure and tension rods, permit the operating of the adjusting disk without a requirement of implementing an adjusting rotating movement.

By an extension of the screw, as an extension of the conical section of the worm, it becomes possible to arrange the adjusting disk and its adjusting unit close to the center. It is also conceivable to lead adjusting forces, for example, by the connecting rods, close to the center through the drum, although the arrangement in the screw or its drive shaft permits an arrangement which is close to the center.

In accordance with the present disclosure, relatively short adjusting paths can also be implemented for changing the outlet cross-section. The adjustment takes place, for example, as a function of the TS (DS) content, or dry substance, of the solids, whose determination is known.

The adjusting disk which may be constructed to be planar or flat, is axially displaceably arranged in the drum. The adjusting disk may also be swivellable.

The adjusting disk may be oriented completely perpendicularly or radially with respect to the axis of rotation of the drum.

An end of the connecting rod facing away from the adjusting disk is directly or indirectly connected with a rod or a pipe, which centrically penetrates an inlet pipe in the axis of rotation of the solid bowl helical conveyor centrifuge. The connecting rod can be constructed as a part which does not go along in the rotation and can be housed in an uncomplicated manner.

The axial displaceability can be implemented by an electromotively operable adjusting or driving unit or a hydraulic or pneumatic device through the screw body, particularly when these act upon the connecting rod which is fastened to the adjusting disk and which penetrates the axial end of the screw body of the screw axially adjoining the distributor. The adjusting unit may also be arranged inside the screw body, such as for example, an electric motor.

The adjusting device may be arranged as an axial extension of the drum end in a space-saving manner in a discharge chamber which axially adjoins the screw.

The adjusting disk may also have recesses which permit a defined minimal passage of solids. The recesses can be distributed on an outer circumference. However, they may also be constructed in the manner of bores, slots or in a segment-type manner. The adjusting disk may be planar and may also have, for example, a curved construction.

The present disclosure also includes a computer-controlled control device for controlling the adjusting disk as a function of the dry-substance content of the solids. A numerical control or the control computer of the machine, which is often assigned to centrifuges, can be shared for this purpose. This control can then act upon the adjusting unit.

Other aspects of the present disclosure will become apparent from the following descriptions when considered in conjunction with the accompanying drawings.

DETAILED DESCRIPTION

Figure 1:
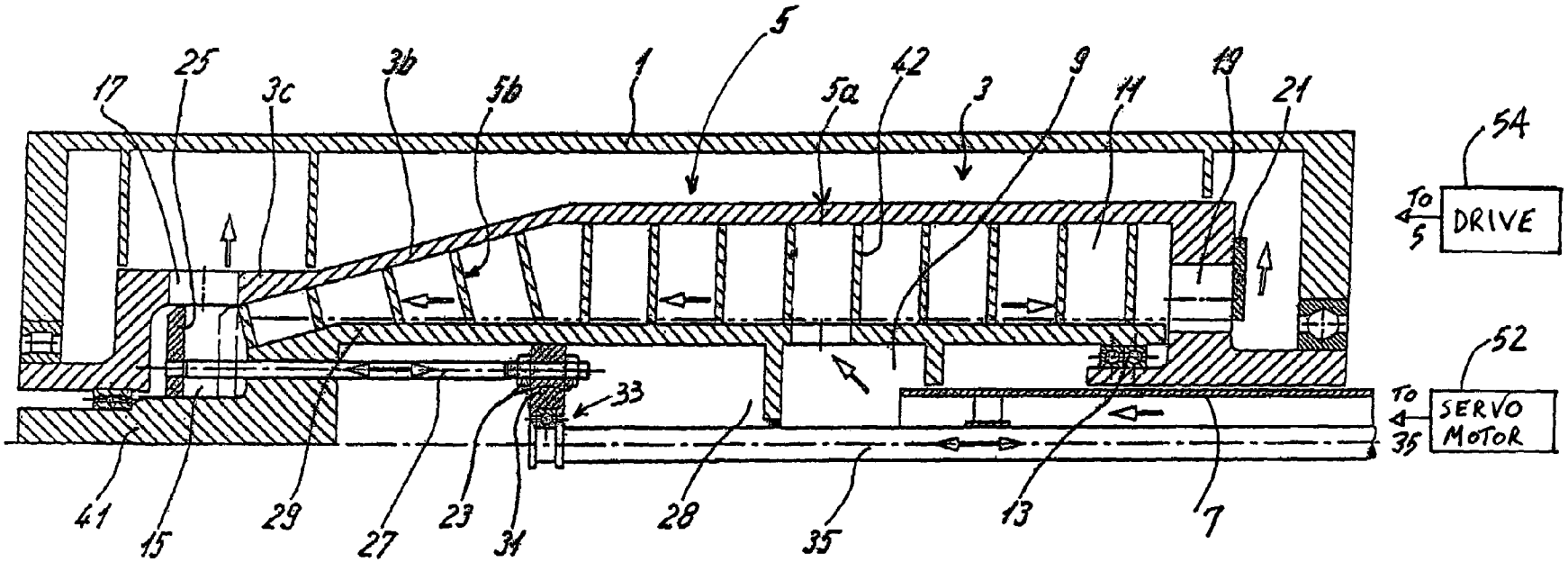
FIG. 1 is a sectional view of an embodiment of a solid bowl helical conveyor centrifuge according to the present disclosure.

FIG. 1 illustrates a solid bowl helical conveyor centrifuge with a machine housing 1 in which a drum 3 is arranged which has a horizontal axis of rotation. A worm or screw 5 is arranged in the drum 3.

The drum 3 and the screw 5 each have an essentially cylindrical section 3*a*, 5*a*, respectively and a conically tapering section 3*b*, 5*b*, respectively, adjoining it. A screw blade 42 surrounds the cylindrical section 5*a* as well as the tapering section 5*b* of the screw or of a screw body 29.

The drum 3 also has another cylindrical section 3*c* which adjoins the conically tapering section 3*b* and which defines a discharge chamber 15 whose diameter is smaller than a diameter of the cylindrical section 3*a* and a diameter in the conical section 3*b* of the drum 3.

An axially extending centric inlet pipe 7 is used for feeding centrifuged material by way of a distributor 9 into a centrifugal chamber 11 between the screw 5 and the drum 3.

When, for example, a sludgy mash in guided into the centrifuge, particles of solids are deposited on a drum wall. A liquid phase forms farther toward an interior of the drum 3.

The screw 5 is disposed on a bearing 13 and rotates at a slightly lower or higher speed than the drum 3 and delivers centrifuged solids toward the conically tapering section 3*b* and beyond it to a cylindrical discharge chamber 15 in a second cylindrical area, or section 3*c*, of the drum 3. The cylindrical discharge chamber 15 adjoins the screw 5 in an axial direction. Drum 3, is provided with at least one discharge opening 17 for the solids leading radially toward an outside of and from the drum 3.

In contrast, liquid flows to a larger drum diameter at a rearward end of the cylindrical section 3*a*, 5*a* of the drum 3 and the liquid is discharged at overflow openings 19 the overflow openings 19 having an adjustable weir 21.

An adjusting device 25 is assigned to the at least one discharge opening 17 for the solids, which adjusting device 25 can be moved such that, by use of the adjusting device 25, a cross-section of the discharge opening 17 is more or less cleared.

In cylindrical section 3*c* of the drum 3, the adjusting device 25 includes an adjusting disk 25 which is arranged as an axial extension of the screw 5. The adjusting disk 25 is axially displaceable and rotates together with the screw 5 or is non-rotatably arranged relative to the screw 5.

The adjusting disk 25 may be aligned perpendicular with respect to an axis of the drum and can be displaced axially below the discharge opening 17, which changes the available outlet cross-section of the discharge opening 17 for the solids. For implementing the displaceability, an outside diameter of the adjusting disk 25 is adapted to an inside diameter of cylindrical section 3*c* of the drum 3.

Figure 4:
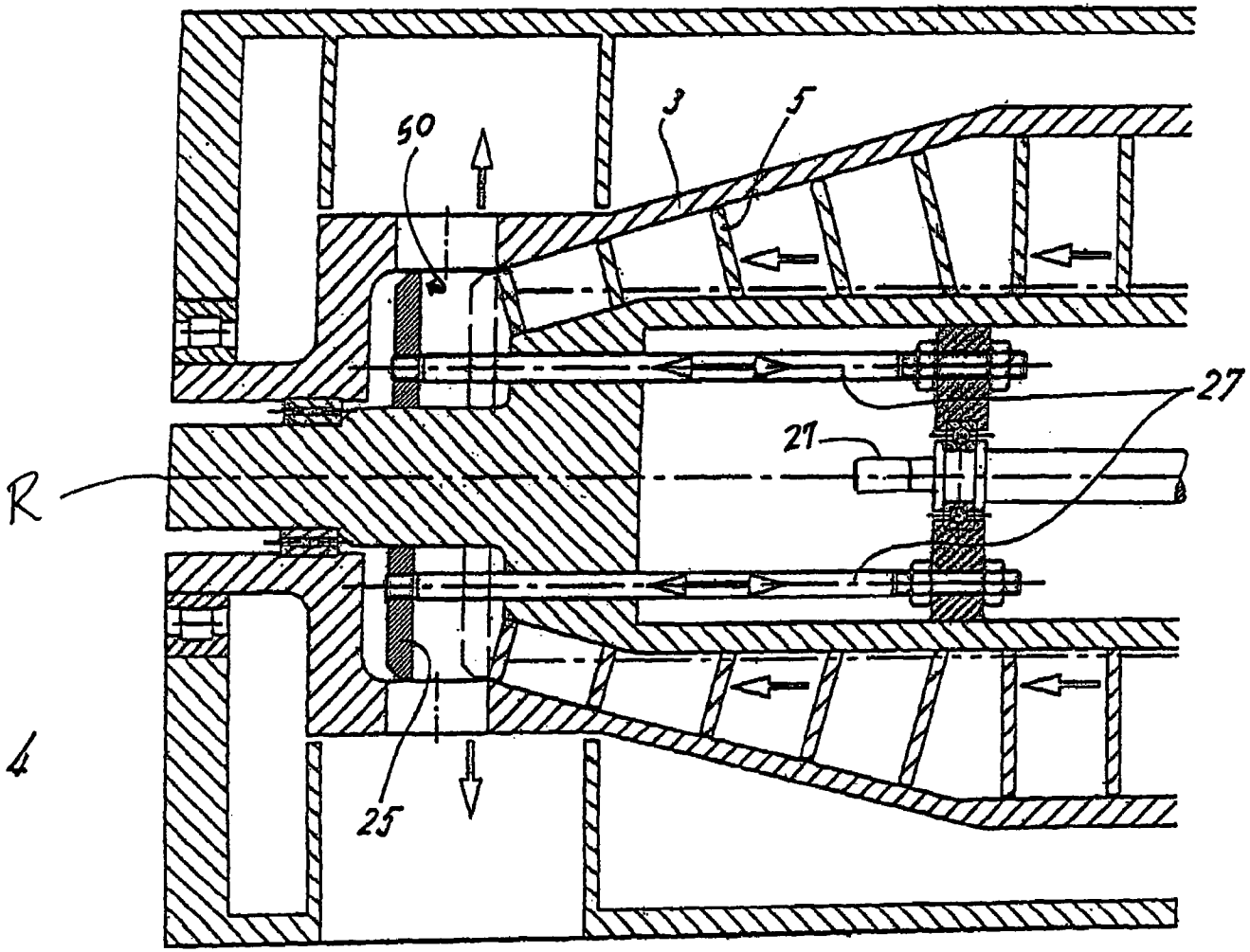
FIG. 4 is a sectional view of an axial end of the solid bowl helical conveyor centrifuge of FIG. 1.

At least one connecting rod 27 is fastened to the adjusting disk 25. The at least one connecting rod 27 is arranged perpendicular to the adjusting disk 25 and penetrates an axial end of screw body 29 of the screw 5 into a chamber 28 in an interior of screw body 29. Chamber 28 axially adjoins a distributor 9 but is not connected with the distributor 9. The at least one connecting rod 27 may be two, three or more, as shown in FIG. 4. The adjusting disk 25 may also include recesses 50 (see FIG. 4) which permit a defined minimal passage of solids. The recesses 50 may be distributed on an outer circumference of the adjusting disk 25 and may be constructed in the form of boxes, slots, or in a segment-type manner.

An end of the at least one connecting rod 27 facing away from the adjusting disk 25 is fastened to a ring 31 by, for example, screw nuts 23. Ring 31 is disposed by a bearing 33 on a rod 35, which rod 35, during an operation of the solid bowl helical conveyor centrifuge, does not rotate along with the screw 5 or drum 3 but stands still and centrically penetrates an inlet pipe 7 in an axis of rotation R of the solid bowl helical conveyor centrifuge.

As a result of the bearing 33, the adjusting disk 25, with the at least one connecting rod 27, can rotate together with the screw 5 during operation of the centrifuge.

When the rod 35 is axially displaced, for example, by a servo motor 52 located outside the drum 3, the bearing 33, the ring 31, the at least one connecting rod 27 and thereby also the adjusting disk 25 are axially displaced which, in turn, changes the discharge cross-section opening 17 for the solids. The servo motor 52 may, for example, be one or more of the following: a) an electromotively operable adjusting unit, b) a hydraulic device, c) a pneumatic device and d) a computer-controlled control device (see FIG. 1).

According to FIG. 1, the inlet pipe 7 does not rotate. In a case of a construction of an inlet pipe which does rotate (not shown), the bearing 13 can also be arranged outside the centrifuge for rotary transmission.

According to the present disclosure, only a relatively low speed difference has to be mechanically overcome. Since a transition from stationary connecting rod 35 to the at least one connecting rod 27 rotating along with the screw 5 is arranged relatively close to a center of the centrifuge or drum 3, only a relatively low speed difference has to be mechanically overcome.

Figure 2:
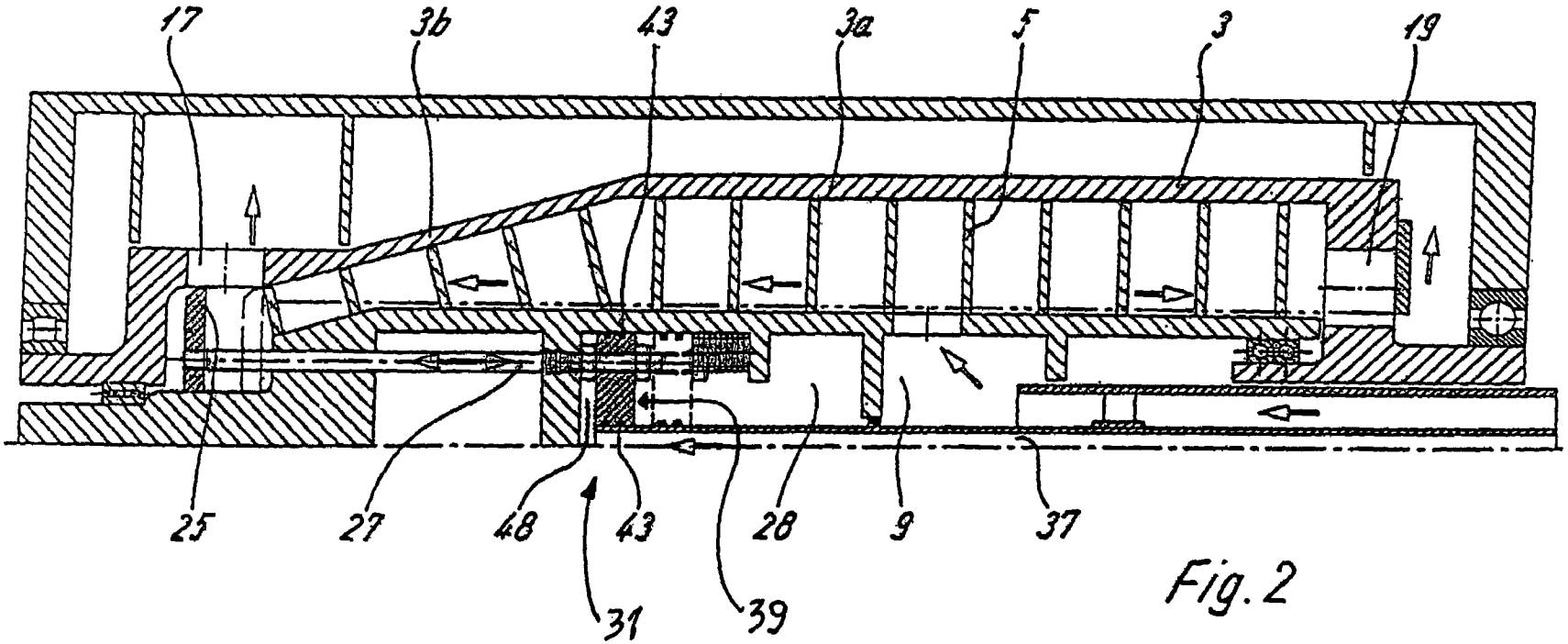
FIG. 2 is a sectional view of another embodiment of solid bowl helical conveyor centrifuge according to the present disclosure.
Figure 3:
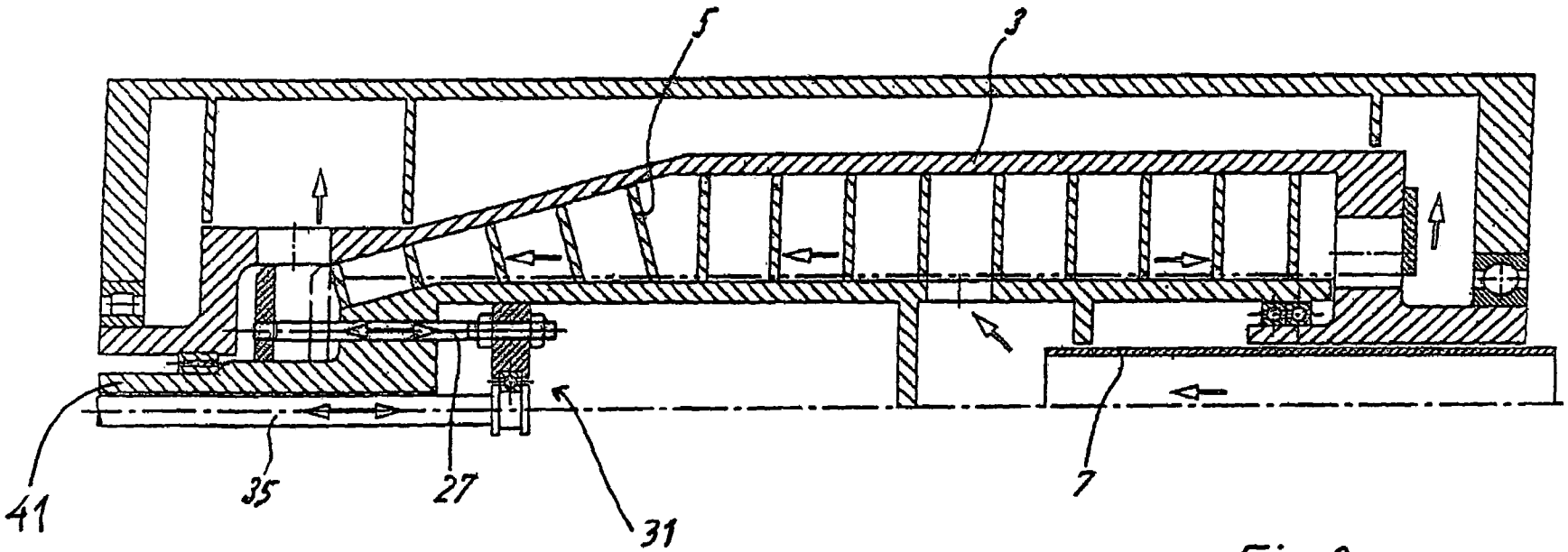
FIG. 3 is a sectional view of another embodiment of a solid bowl helical conveyor centrifuge according to the present disclosure.

Depending on a construction of the decanter, or the centrifuge, the stationary connecting rod 35 connected to the servo motor 52 can be guided, as shown in FIG. 1, through the feeding pipe 7 or, for example, as shown in FIG. 3, through a screw drive shaft 41 to the non-rotatable ring 31. The at least one connecting rod 27 is arranged on an end situated opposite a drive 54, for example, of the screw 5 and drum 3. If the drive 54 were, for example, in FIG. 2, arranged to the left of FIG. 2 or on a tapering end of the drum 3, the connecting rod 35 would be guided from an opposite or cylindrical end of the drum 3 into the drum 3. The arrangement of the rod 35 is shown reversed in FIG. 3, with respect to FIG. 1.

FIG. 2 differs from FIG. 1 by a manner of operation of the adjusting disk 25.

According to FIG. 2, the ring 31 does not run on a bearing but is used as a piston-type sliding element 39, which can be operated by a fluid. The rod 35 is replaced by a pipe 37 which is used for feeding and removing of the fluid, for example, a hydraulic fluid such as water, into and out of pressure chamber 48.

Evacuation of the fluid can also take place by way of one or more bores in the screw body 29 (not shown).

An axial position of the sliding element 39, and thus a position of the adjusting disk 25, depends on the inflowing quantity of the adjusting fluid and on a counteracting solids delivery force acting upon the adjusting disk 25, which delivery force also acts as a restoring force. The sliding element 39 is sealed off with O-rings 43 on an interior wall of the cylindrical section 3*a* of the screw body 29 and on the pipe 37 and is axially displaceable.

Figure 5:
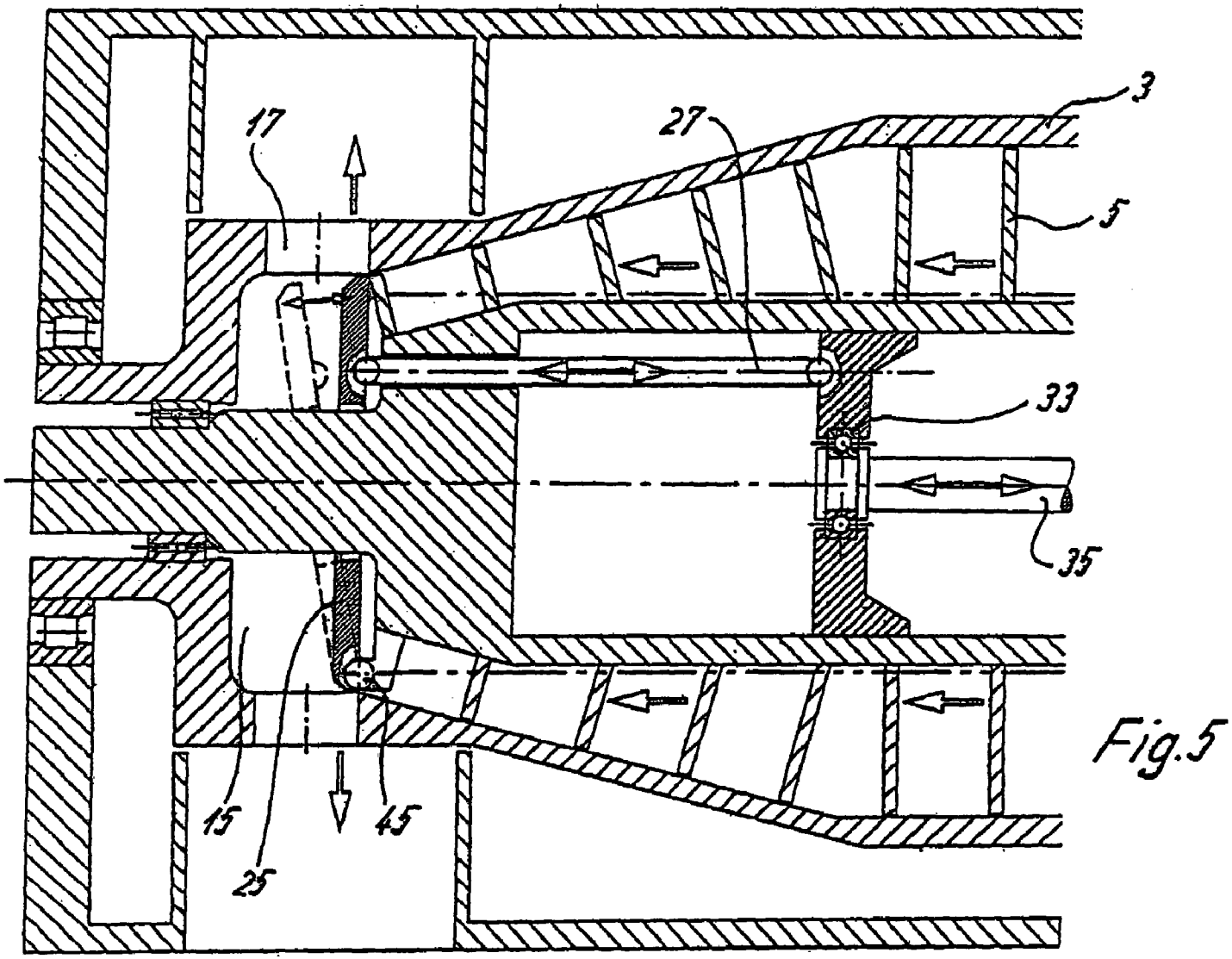
FIG. 5 is a sectional view of another embodiment of a solid bowl helical conveyor centrifuge, according to the present disclosure.

FIG. 5 shows an embodiment having a swivellable adjusting disk 25, which implements a required axial mobility or displaceability with respect to an end of the screw 5. By a shaft 45 or of a hinge (not shown), the adjusting disk 25 is swivellably linked to the axial end of the screw 5. Whereas, the at least one connecting rod 27 is linked to a peripheral area of the adjusting disk 25. As a result, the cross-section of the solids discharge opening 17 available for the discharge of the solids can also be changed. The hinge (not shown) is situated opposite a screw opening at the end of the screw 5.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A solid bowl helical conveyor centrifuge, comprising:

a rotatable drum having a horizontally-oriented axis of rotation;

a rotatable screw arranged in the rotatable drum;

at least one discharge opening oriented at an angle with respect to the horizontally-oriented axis of rotation, the at least one discharge opening configured to discharge solids from the rotatable drum;

an adjusting device assigned to the at least one discharge opening, by which adjusting device an outlet cross-section of the at least one discharge opening is changeable and the adjusting device includes a movable adjusting disk arranged in the rotatable drum as an extension of the rotatable screw, and which movable adjusting disk is non-rotatably connected with one or more of the following: a) the rotatable drum, b) the rotatable screw, and c) a screw body;

at least one connecting rod fastened to the movable adjusting disk; and wherein an end of the at least one connecting rod facing away from the movable adjusting disk is one of directly and indirectly connected with one of a rod and a pipe which centrically penetrates an inlet pipe in the horizontally-oriented axis of rotation of the solid bowl helical conveyor centrifuge.

2. The solid bowl helical conveyor centrifuge according to claim 1, wherein the at least one discharge opening extends radially toward an outside of the drum.

3. The solid bowl helical conveyor centrifuge according to claim 1, wherein the at least one connecting rod is guided through the rotatable screw from an end of the rotatable drum situated opposite a drive of the helical conveyor centrifuge.

4. The solid bowl helical conveyor centrifuge according to the claim 1, wherein the movable adjusting disk is oriented radially with respect to the horizontally-oriented axis of rotation of the solid bowl helical conveyor centrifuge.

5. The solid bowl helical conveyor centrifuge according to claim 1, wherein the movable adjusting disk is arranged as an axial extension of an end of the rotatable drum in a discharge chamber axially adjoining the screw.

6. The solid bowl helical conveyor centrifuge according to claim 1, wherein the movable adjusting disk is axially displaceable in the rotatable drum.

7. The solid bowl helical conveyor centrifuge according to claim 1, wherein the movable adjusting disk is configured to be swivellable.

8. The solid bowl helical conveyor centrifuge according to claim 1, wherein the movable adjusting disk is swivellably linked to an axial end of the screw.

9. The solid bowl helical conveyor centrifuge according to claim 1, wherein the at least one connecting rod includes three connecting rods fastened to the adjusting disk.

10. The solid bowl helical conveyor centrifuge of claim 9, wherein the three connecting rods penetrate an axial end of at least one of a) a screw body and b) a screw drive shaft of the screw into a diameter in the screw body.

11. The solid bowl helical conveyor centrifuge according to claim 1, wherein the at least one connecting rod penetrates an axial end of at least one of the following: a) the screw body and b) a screw drive shaft of the screw into a chamber in the screw body.

12. The solid bowl helical conveyor centrifuge according to claim 11, wherein the chamber adjoins a distributor.

13. The solid bowl helical conveyor centrifuge according to claim 1, wherein the at least one connecting rod is guided from a cylindrical end of the rotatable drum through the screw.

14. The solid bowl helical conveyor centrifuge according to claim 1, wherein the movable adjusting disk is adjustable by an electromotively operable adjusting unit.

15. The solid bowl helical conveyor centrifuge according to claim 1, wherein the movable adjusting disk is adjustable by at least one of the following: a) an hydraulic device and b) a pneumatic device.

16. The solid bowl helical conveyor centrifuge according to claim 1, wherein the movable adjusting disk includes recesses.

17. The solid bowl helical conveyor centrifuge according to claim 1, further including a computer-controlled control device for controlling the movable adjusting disk.

18. The solid bowl helical conveyor centrifuge of claim 17, wherein the computer-controller control device controls the movable adjusting disk as a function of a dry substance content of the solids.

19. A solid bowl helical conveyor centrifuge, comprising:

a rotatable drum having a horizontally-oriented axis of rotation;

a rotatable screw arranged in the rotatable drum;

at least one discharge opening oriented at an angle with respect to the horizontally-oriented axis of rotation, the at least one discharge opening configured to discharge solids from the rotatable drum;

an adjusting device assigned to the at least one discharge opening, by which adjusting device an outlet cross-section of the at least one discharge opening is changeable and the adjusting device includes a movable adjusting disk arranged in the rotatable drum as an extension of the rotatable screw, and which movable adjusting disk is non-rotatably connected with one or more of the following: a) the rotatable drum, b) the rotatable screw, and c) a screw body;

at least one connecting rod fastened to the movable adjusting disk; and wherein an end of the at least one connecting rod facing away from the movable adjusting disk is fastened to a ring which is disposed by a bearing on a stationary connecting rod which centrically penetrates an inlet pipe in the horizontally-oriented axis of rotation of the solid bowl helical conveyor centrifuge.

20. The solid bowl helical conveyor centrifuge according to claim 19, wherein the stationary connecting rod is operated by at least one of the following: a) an electromotively operable adjusting unit and b) an hydraulic device.

21. The solid bowl helical conveyor centrifuge according to claim 19, wherein the ring is constructed as a sliding element operable by a fluid.

22. A solid bowl helical conveyor centrifuge, comprising:

a rotatable drum having a horizontally-oriented axis of rotation;

a rotatable screw arranged in the rotatable drum;

at least one discharge opening oriented at an angle with respect to the horizontally-oriented axis of rotation, the at least one discharge opening configured to discharge solids from the rotatable drum;

an adjusting device assigned to the at least one discharge opening, by which adjusting device an outlet cross-section of the at least one discharge opening is changeable and the adjusting device includes a movable adjusting disk arranged in the rotatable drum as an extension of the rotatable screw, and which movable adjusting disk is non-rotatably connected with one or more of the following: a) the rotatable drum, b) the rotatable screw, and c) a screw body;

at least one connecting rod fastened to the movable adjusting disk; and wherein a pipe penetrates an inlet pipe for material to be centrifuged and leads into a chamber used as a feeding and removing device for a fluid that operates a sliding element.

23. The solid bowl helical conveyor centrifuge according to claim 22, wherein the inlet pipe does not rotate along with the screw.

24. The solid bowl helical conveyor centrifuge according to claim 22, wherein the inlet pipe rotates along with the screw.

* * * * *